US006652173B1

(12) United States Patent
Martini et al.

(10) Patent No.: US 6,652,173 B1
(45) Date of Patent: Nov. 25, 2003

(54) TICKET DISPENSING MECHANISM

(75) Inventors: Calvin Duke Martini, Riverview (CA); Eugene Anthony Helmetsie, Spencer, NY (US); Paul Chiasson, Diappe (CA)

(73) Assignee: Spielo Manufacturing Incorporated (CA)

( * ) Notice: Subject to any disclaimer, the term of this patent is extended or adjusted under 35 U.S.C. 154(b) by 0 days.

(21) Appl. No.: 09/763,895

(22) PCT Filed: Aug. 24, 1999

(86) PCT No.: PCT/CA99/00776

§ 371 (c)(1),
(2), (4) Date: Jul. 10, 2001

(87) PCT Pub. No.: WO00/11615

PCT Pub. Date: Mar. 2, 2000

(51) Int. Cl.[7] ..... B41J 11/66

(52) U.S. Cl. ..... 400/621; 400/605; 400/617; 400/619; 101/66; 493/324; 83/94

(58) Field of Search ..... 101/66, 67, 68, 101/69, 232; 493/320, 324; 400/621, 578, 605, 611, 617, 619; 83/94

(56) References Cited

U.S. PATENT DOCUMENTS

| | | | | | |
|---|---|---|---|---|---|
| 4,116,127 | A | * | 9/1978 | McInerny | 101/232 |
| 4,422,376 | A | * | 12/1983 | Teraoka | 101/306 |
| 6,162,159 | A | * | 12/2000 | Martini et al. | 493/320 |
| 6,222,576 | B1 | * | 4/2001 | Goto | 347/218 |
| 6,409,043 | B1 | * | 6/2002 | Fujita et al. | 271/10.03 |

* cited by examiner

*Primary Examiner*—Andrew H. Hirshfeld
*Assistant Examiner*—Dave A. Ghatt
(74) *Attorney, Agent, or Firm*—Piper Rudnick LLP; Jefferson Perkins

(57) ABSTRACT

A ticket dispensing mechanism (40) includes a drive (42) receiving sheet material (24) from a supply (22). The drive advances the sheet material. A printer (48) prints ticket information on the sheet material as it is advanced by the drive thereby to form a printed ticket. A retaining mechanism (64) receives the printed ticket advanced by the drive and holds the printed ticket in a manner such that the leading end of the next ticket printed contacts and ejects the held ticket prior to itself being held by the retaining mechanism.

55 Claims, 8 Drawing Sheets

TICKET DISPENSING MECHANISM

TECHNICAL FIELD

The present invention relates generally to dispensers and in particular to a ticket dispensing mechanism to print and dispense tickets wherein the leading end of one ticket is used to push and eject and earlier printed ticket from the ticket dispensing mechanism.

BACKGROUND ART

Ticket printing and dispensing devices are well known in the art and many variations have been considered. For example, U.S. Pat. No. 4,592,669 to Lohse et al. discloses a direct-recording printer and a housing structure therefor. The direct-recording printer includes a thermo printer contacting a paper web as it is advanced by a platen. Once the web has been printed, it exits the housing along a horizontal pass beneath a cutting bar. A cutting edge on the end of the cutting bar allows the paper web to be cut.

U.S. Pat. No. 4,422,376 to Teraoka discloses a label printer to print labels on a roll. Once the labels are printed, they are ejected from the printer housing at an angle through a slot in the printer housing.

U.S. Pat. No. 3,593,833 to Bretti discloses a device for supporting and guiding a roll of paper in an accounting machine. The machine has a reservoir for a paper roll, with rollers in the bottom of the reservoir to facilitate rolling of the roll as the web is unwound from the roll.

U.S. Pat. No. 4,695,171 to Sapitowicz, discloses a horizontally or vertically orientable compact ticket processor. The ticket processor has a U-shaped transport pass with input and output slots in closely situated parallel planes. An overrunning clutch forms part of the transport drive between the reader and the printer to shorten the transport pass by permitting the leading edge of the ticket to enter the printer while the ticket is being read by the reader. In operation, individual tickets are fed into the input slot and are conveyed to the printer before being discharged via the output slot.

Although the above-identified patents disclose different ticket printing and dispensing devices, these devices incorporate complex mechanical solutions to print and dispense printed tickets. Accordingly, improved ticket dispensing mechanisms are desired. It is therefore an object of the present invention to provide a novel ticket dispensing mechanism.

DISCLOSURE OF THE INVENTION

According to one aspect of the present invention there is provided a ticket dispensing mechanism comprising:

- a drive receiving sheet material from a supply and advancing said sheet material;
- a printer to print ticket information on the sheet material thereby to form a printed ticket; and
- a retaining mechanism receiving the printed ticket advanced by said drive, said retaining mechanism holding said printed ticket in a manner such that the leading end of the next ticket printed contacts and ejects the held ticket prior to itself being held by said retaining mechanism.

According to another aspect of the present invention there is provided a ticket dispenser comprising:

- a housing defining an internal chamber for receiving a roll of paper web;

- a drive receiving said paper web and advancing said paper web when a ticket is to be formed;
- a printer to print ticket information on said paper web as it is advanced by said drive;
- a retaining mechanism receiving the printed paper web advanced by said drive; and
- a cutting device to cut said paper web after said paper web has been printed and advanced to said retaining mechanism thereby to separate a ticket from said paper web, wherein said retaining mechanism holds said ticket and guides said paper web in a manner such that when the paper web is advanced by said drive during formation of the next ticket, the leading end of the paper web contacts and ejects the held ticket from said housing.

According to yet another aspect of the present invention there is provided a method of dispensing sequentially printed tickets comprising the steps of:

- after each ticket is printed, advancing the ticket to a retaining mechanism; and
- retaining the ticket in a manner such that when the next ticket is advanced, the next ticket contacts and ejects the retained ticket prior to itself being retained.

The present invention provides advantages in that tickets are printed and ejected by the ticket dispensing mechanism in a simple, consistent and reliable manner using the leading end of one ticket to contact and eject the previously printed ticket.

BRIEF DESCRIPTION OF THE DRAWINGS

Embodiments of the present invention will now be described more fully with reference to the accompanying drawings in which.

BEST MODES FOR CARRYING OUT THE INVENTION

Figure 1:
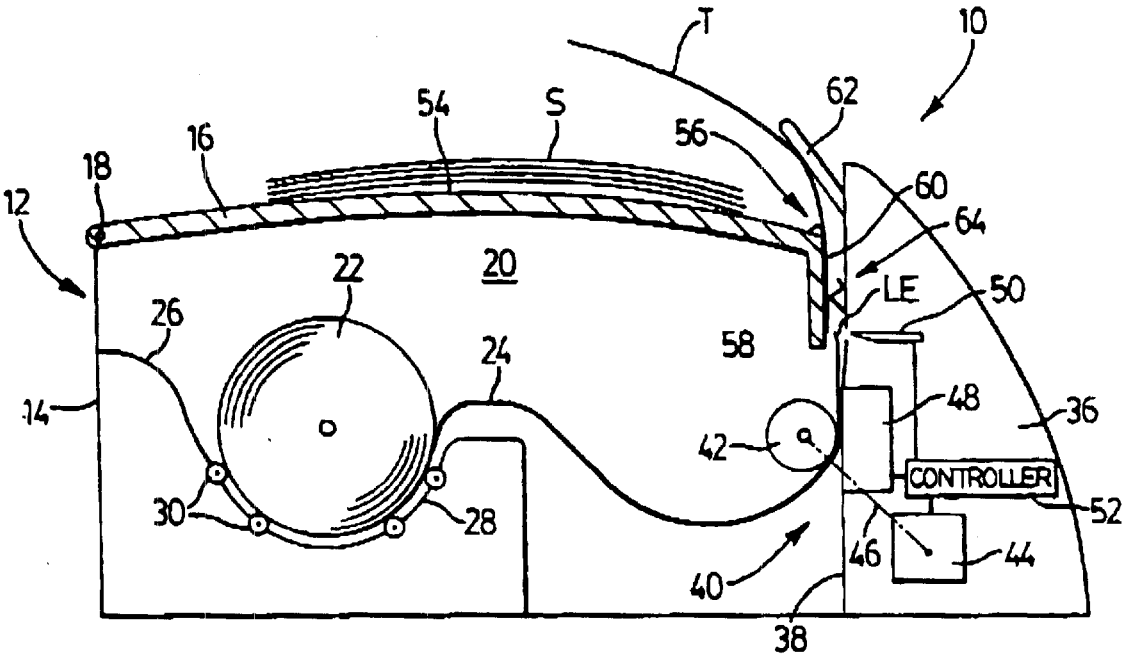
FIG. 1 is a schematic, vertical sectional view of a ticket dispenser incorporating a ticket dispensing mechanism in accordance with the present invention.
Figure 2:
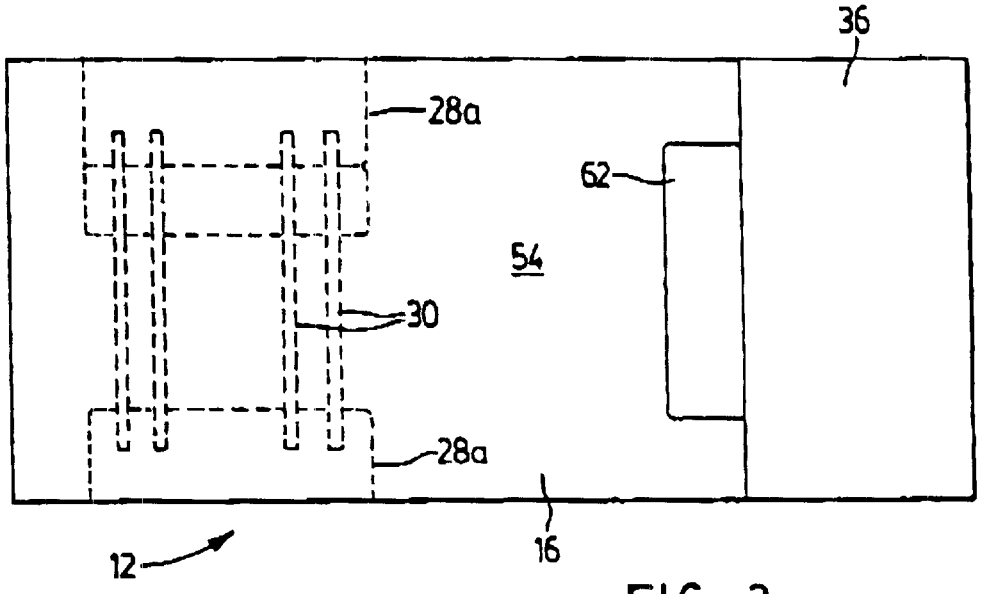
FIG. 2 is a top plan view of the ticket dispenser of FIG. 1.

Referring now to FIGS. 1 and 2, a ticket dispenser to print and dispense tickets is shown and is generally indicated to by reference numeral 10. As can be seen, the ticket dispenser 10 includes a clamshell type housing 12 having a dispenser body 14 and a lid 16 pivotally mounted on the dispenser body 14 about a pivot axis 18. The dispenser body 14 defines an internal chamber 20 adapted to receive a roll 22 of paper web 24 on which tickets to be dispensed are printed.

The internal chamber 20 includes a curved support surface 26 defining a barrel 28 to accommodate the roll 22. The barrel 28 includes sidewalls 28*a* which may be adjustable to allow narrower rolls 22 of paper web 24 to be accommodated by the internal chamber 20. Barrel rollers 30 are accommodated by openings in the barrel 28 at spaced location to facilitate unwinding of the roll 22 and reduce friction associated with heavy rolls thereby to obviate the need for a spindle to support the roll.

Positioned at one end of the internal chamber 20 is an enclosure 36, which presents a generally upright paper guide wall 38 towards the internal chamber 20. A ticket dispensing mechanism generally identified by reference numeral 40 is partially accommodated by the enclosure 36 and includes a platen 42 disposed in the internal chamber 20 adjacent the guide wall 38. Platen 42 is rotated by a motor 44 within the enclosure 36 through a transmission represented by dashed line 46.

Ticket dispensing mechanism 40 also includes a print head 48 adjacent the platen 42, a cutting blade 50 disposed above the print head 48 and a retaining mechanism 64 above the cutting blade 50. Cutting blade 50 is moveable from a retracted position within the enclosure 36 to an operative position where it extends into the internal chamber 20 through an opening in the guide wall 38. A controller 52 within the enclosure 36 communicates with the motor 44, the print head 48 and the cutting blade 50 to synchronize operation of the ticket dispenser 10. Although not shown, if desired, a paper low sensor to detect standard markings placed along one side of the paper web 24 near the end of the roll may be provided at the print head 48.

The lid 16 defines an upper ticket receiving surface 54 and has an upstanding lip 56 formed along its distal end defining an edge. A flange 58 depends from the distal end of the lid 16. When the lid 16 is in a closed position, as shown in FIG. 1, the flange 58 presents a substantially upright planar wall 60 that is positioned above, generally parallel with, but inwardly (leftwardly) offset from the guide wall 38.

A deflector 62 is supported by the dispenser body 14 and extends upwardly and away from guide wall 38 above the lip 56. The deflector 62 is designed to deflect, toward the ticket receiving surface 54, tickets which rise upwardly beyond the edge defined by the lip 56.

Figure 3A:
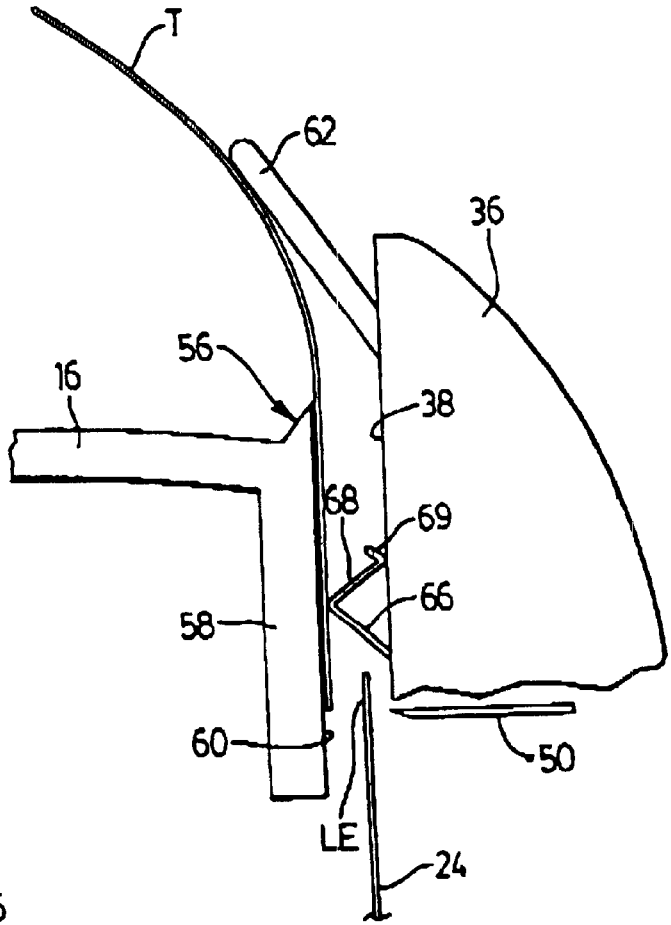
FIGS. 3*a* and 3*b* are schematic drawings of the ticket dispensing mechanism forming part of the ticket dispenser of FIG. 1, to a larger scale than FIG. 1.
Figure 3B:
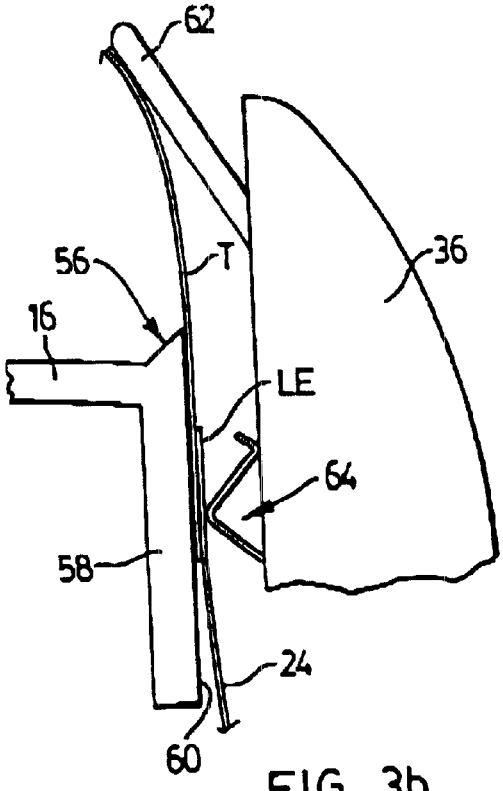

The retaining mechanism 64 is best seen in FIGS. 3*a* and 3*b*. In this embodiment, the retaining mechanism is designed to hold a printed ticket in a generally vertical orientation as well as guide the advancing paper web 24 so that the paper web frictionally engages with the held printed ticket. As can be seen, the retaining mechanism is in the form of a relatively flexible retainer strip mounted on the guide wall 38 adjacent the upright wall 60. The flexible retainer strip 64 includes a first flank 66, which is integral with a second flank 68 through a right-angle bend. The second flank 68 terminates in a small ledge 69, giving the retainer strip 64 a generally Z-shaped profile. The angulation of the flank 66 provides a guiding or "funneling" function so that the rising leading end LE of the paper web 24 is deflected and passes between the upright wall 60 and the flexible retainer strip 64.

The operation of the ticket dispenser 10 will now be described. Initially, the ticket dispenser 10 is loaded with a roll 22 of paper web 24 by pivoting the lid 16 upwardly about the pivot axis 18 to expose the internal chamber 20. The roll 22 is the placed on the barrel 28 and the free leading end LE of the paper web 24 is threaded between the platen 42 and the print head 48 and upwardly along the guide wall 38. The lid 16 is then closed with the paper web 24 being positioned in the ticket path defined by the space between the upright walls 38 and 60 respectively.

When a ticket is to be printed and dispensed from the ticket dispenser 10, controller 52 causes the motor 44 to rotate the platen 42 counter-clockwise through transmission 46. Rotation of the platen 42 in this manner unwinds the paper web 24 from the roll 22. As the paper web 24 is advanced by the platen 42, the print head 48 prints ticket information on the side of the paper web 24 directed away from the platen 42. The leading end LE of the paper web 24 in turn moves upwardly along the guide wall 38 towards the flank 66 of the retainer strip 64. When the leading end LE of the paper web 24 contacts the flank 66, the leading end LE of the paper web 24 is deflected toward the upright wall 60. As the paper web 24 moves upwardly further, the paper web 24 passes between the retainer strip 64 and the upright wall 60. As a result of its resilient biased nature, the retainer strip 64 presses the paper web 24 against the upright wall 60.

Once the desired information has been printed on the paper web 24 by the print head 48 and the paper web 24 has been advanced sufficiently by the platen 42 so that a portion of the paper web extends out of the dispenser body 14, the controller 52 actuates the cutting blade 50. The cutting blade 50 in response to the controller 52 moves from its retracted position to its extended position and then back to its retracted position. During this cycle, the cutting blade 50 cuts the paper web 24 thereby to separate a ticket T from the paper web 24. The bottom portion of the ticket T separated from the paper web 24 is held against the upright wall 60 in a generally vertical orientation by the retainer strip 64 as shown in FIG. 3*a*.

When the next ticket is to be printed and dispensed by the ticket dispenser 10, the above process is repeated. However, when the leading end LE of the paper web 24 passes between the retainer strip 64 and the upright wall 60 after having been deflected toward the upright wall 60 by flank 66, the leading end LE of the paper web 24 frictionally overlaps with the previously formed ticket T pinned to the upright wall 60 by the retainer strip 64 as shown in FIG. 3*b*. During advancement of the paper web 24, a point is reached at which the frictional drag between the previously formed ticket T and the paper web 24 is sufficient to entrain the ticket T so that the ticket T advances with the paper web 24, thus ejecting the ticket T from the dispenser body 14. As further tickets are printed, the cycle repeats, with sequential tickets being printed and severed, and with each printed and severed ticket being ejected from the dispenser body 14 by frictional contact with the next ticket in sequence. Thus, the retainer mechanism 64 orients each held ticket and guides the advancing paper web 24 towards the held ticket so that each held ticket is ejected from the ticket dispensing mechanism in a consistent manner.

As each ticket T is ejected from the dispenser body 14, the ticket contacts the deflector 62 and is deflected toward the ticket receiving surface 54 of the lid 16. As a result, sequential tickets ejected from the dispenser body 14 form a stack S on the ticket receiving surface 54 with the information printed on the tickets facing upwardly.

Although the ticket dispensing mechanism 40 is shown incorporated in a ticket dispenser having a clamshell type housing 12, those of skill in the art will appreciate that the ticket dispensing mechanism may be used in other types of ticket dispensers. For example, the ticket dispensing mechanism 40 may be mounted on a frame installed as a component of another apparatus.

Figure 4:
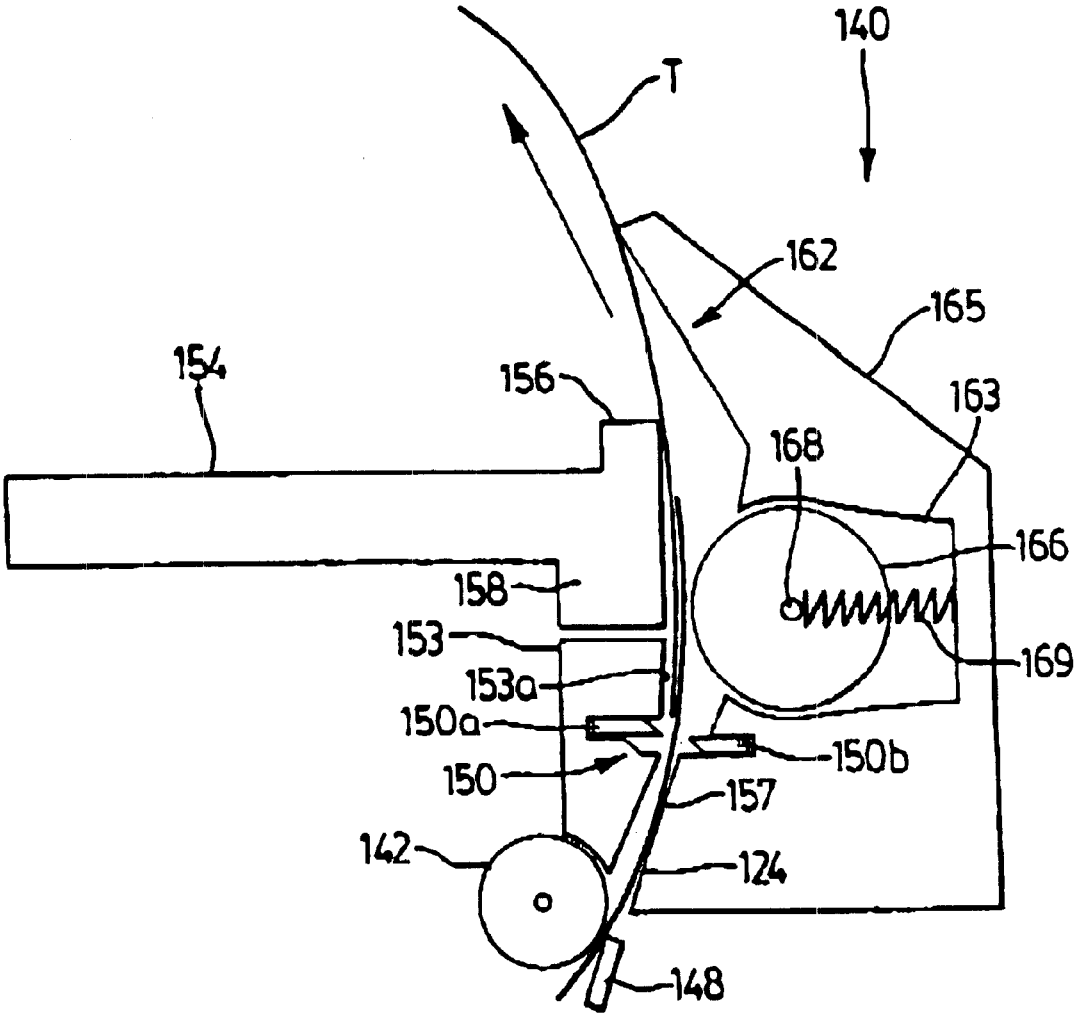
FIG. 4 is a schematic drawing of an alternative embodiment of a ticket dispensing mechanism in accordance with the present invention.

Turning now to FIG. 4, an alternative embodiment of a ticket dispensing mechanism for a ticket dispenser in accordance with the present invention is shown. In this embodiment, like reference numerals will be used to indicate like components with a "100" added for clarity. As can be seen, the ticket dispensing mechanism 140 includes a platen 142, a print head 148 adjacent the platen 142, a cutting device 150 disposed above the platen 142 and a retaining mechanism 164 disposed above the cutting device 150.

The cutting device 150 in this embodiment includes a pair of reciprocating cutting blades 150*a* and 150*b*. One of the cutting blades 150*a* is accommodated in a blade support 153 positioned above the platen 142. The other cutting blade 150*b* is accommodated in a recess provided in a paper guide 155. The paper guide 155 presents a guide wall 157 that is angled at its upper extent towards a ticket tray 154 thereby to define a deflector 162. A second recess 163 is provided in the paper guide 155 above the cutting blade 150*b* to accommodate the retaining mechanism 164.

The ticket tray 154 has a rectangular lip 156 along one end thereof. A flange 158 depends from the end of the ticket tray 154 and presents an upright wall 160 in line with the upper portion of a wall 153*a* of blade support 153.

The retaining mechanism 164 in this embodiment includes a wheel 166 formed of plastic that is rotatably mounted on a shaft 168. A portion of the periphery of the wheel 166 extends into the space between the guide wall 157 and guide wall 160. The wheel 166 is biased towards the guide wall 160 by a spring 169 acting between the wheel 166 and the paper guide 155.

In this embodiment, during operation, as the paper web 124 is advanced, the periphery of the wheel 166 extending into the space between the guide walls 157 and 160 deflects the leading end of the paper web 124 towards the upright wall 160. As the paper web 124 moves upwardly further, the paper web 124 passes between the wheel 166 and the upright wall. The wheel 166, which is biased towards the upright wall 160 by the spring 169, presses the paper web 124 against the upright wall 160. After the paper web has been cut by the cutting blades 150*a* and 150*b* to separate a ticket T from the paper web 124, the wheel 166 holds the bottom portion of the ticket against the upright wall 160 in a general vertical orientation. As a result, when the paper web 124 is advanced to print and dispense the next ticket, the paper web frictionally overlaps with the previously formed ticket held between the wheel 166 and the upright wall 160 and ejects the ticket in the manner described with reference to the previous embodiment. The ejected ticket is deflected by deflector 162 onto the upper surface of the ticket tray 154.

Figure 5:
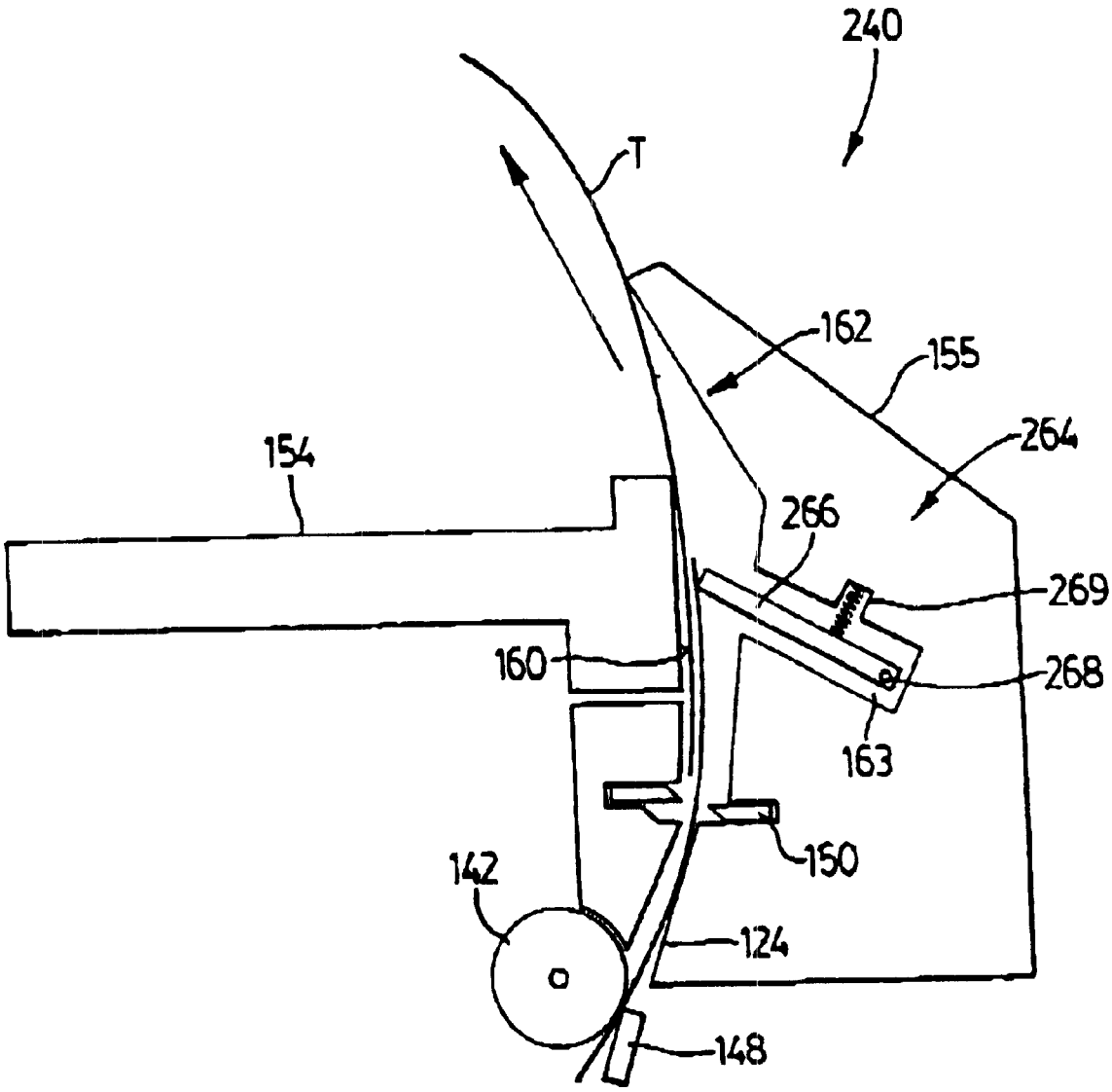
FIG. 5 is a schematic drawing of another alternative embodiment of a ticket dispensing mechanism in accordance with the present invention.

FIG. 5 shows another embodiment of a ticket dispensing mechanism 240 in accordance with the present invention. The ticket dispensing mechanism 240 is very similar to the previous embodiment with the exception of the retaining mechanism 264. The retaining mechanism 264 in this embodiment includes a planar, rectangular plate 266 accommodated by recess 163 in the paper guide 155. The plate 266 is coupled to the paper guide 155 at one end by a hinge 268. The plate 266 is upwardly inclined towards the upright wall 160. A spring 269 acts between the paper guide 155 and the upper surface of the plate 266 to urge the plate in a downward direction about the hinge 268. In this manner, the spring 269 biases the free distal end of the plate 266 downwardly towards the upright wall 160.

The operation of the ticket dispensing mechanism 240 in this embodiment is very similar to that of the previous embodiment. When the paper web 124 is advanced, the portion of the plate 266 extending into the ticket path deflects the leading end of the paper web 124 towards the upright wall 160. As the paper web 124 moves upwardly further, the paper web 124 passes between the free distal end of the plate 266 and the upright wall 160. The plate 266, which is biased towards the upright wall 160 by the spring 269, presses the paper web 124 against the upright wall 160. After the paper has been cut by the cutting device 150 to separate a ticket T from the paper web 124, the plate 266 holds the bottom portion of the ticket T against the upright wall 160 in a general vertical orientation. As a result, when the paper web 124 is advanced to print and dispense the next ticket, the paper web 124 frictionally overlaps with the previously formed ticket held between the plate 266 and the upright wall 160 and ejects the ticket.

Figure 6:
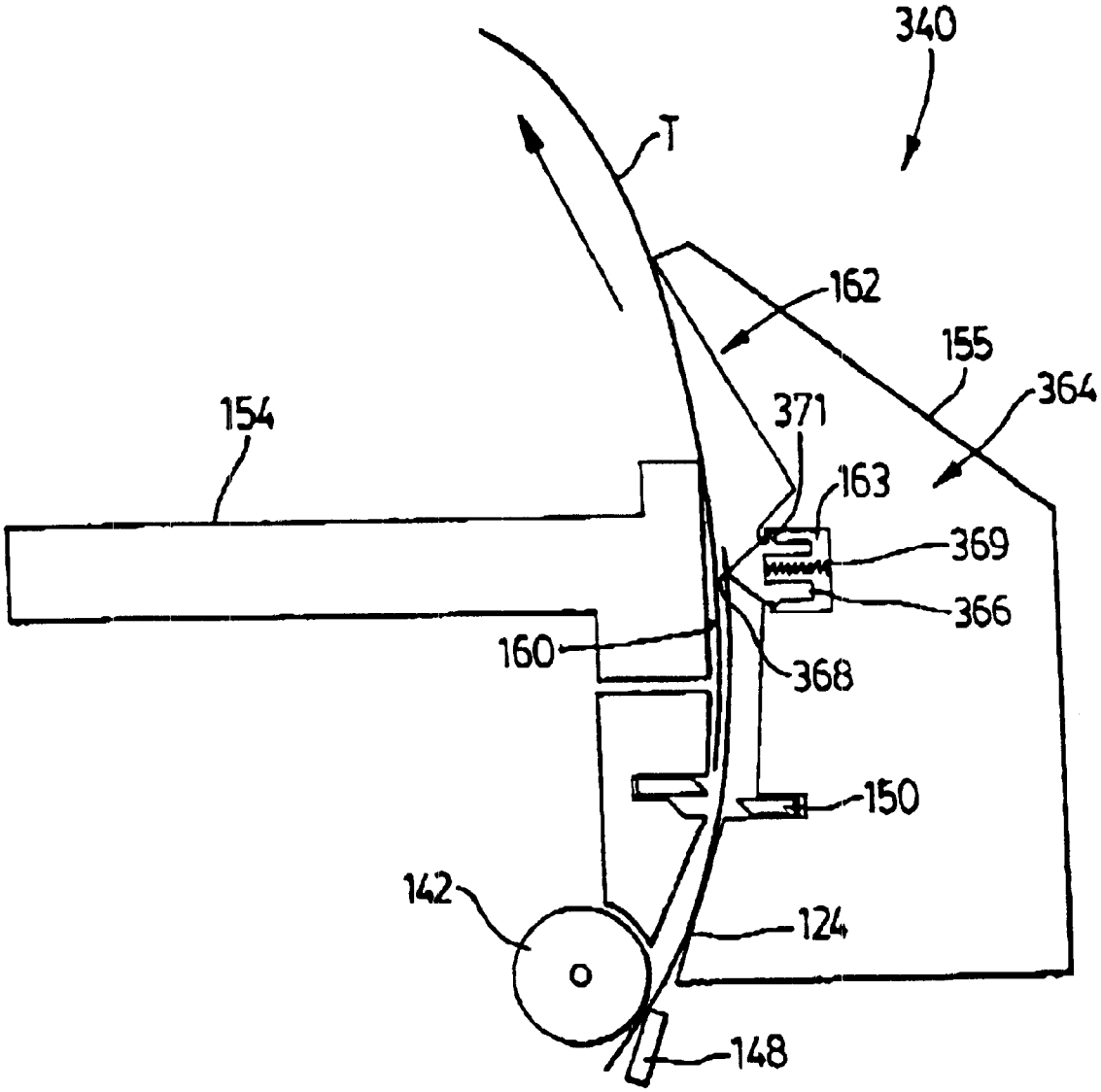
FIG. 6 is a schematic drawing of yet another alternative embodiment of a ticket dispensing mechanism in accordance with the present invention.

In the embodiment of FIG. 6, the ticket dispensing mechanism 340 includes a retaining mechanism 364 having a rigid deflector 366 accommodated by recess 163 in the paper guide 155. The deflector 366 includes a pointed end 368 extending into the ticket path towards upright wall 160. A spring 369 acts between the deflector and the paper guide 155 to bias the deflector 366 towards the upright wall 160. Stops 371 on the deflector 366 interact with stops 373 on the paper guide 155 that extend into the recess 163 to limit the extent of movement of the deflector towards the upright wall 160. The deflector 366, which is biased into contact with the upright wall 160 by the spring 369, deflects the leading end of the paper web 124 between its pointed end 268 and the upright wall 160 and holds the bottom portion of the ticket T in a general vertical orientation after the cutting device 150 has been actuated to cut the paper web 124. As a result, when the paper web 124 is advanced to print and dispense the next ticket, the paper web 124 frictionally overlaps with the previously formed ticket held between the deflector 366 and the upright wall 160 and ejects the ticket.

Figure 7:
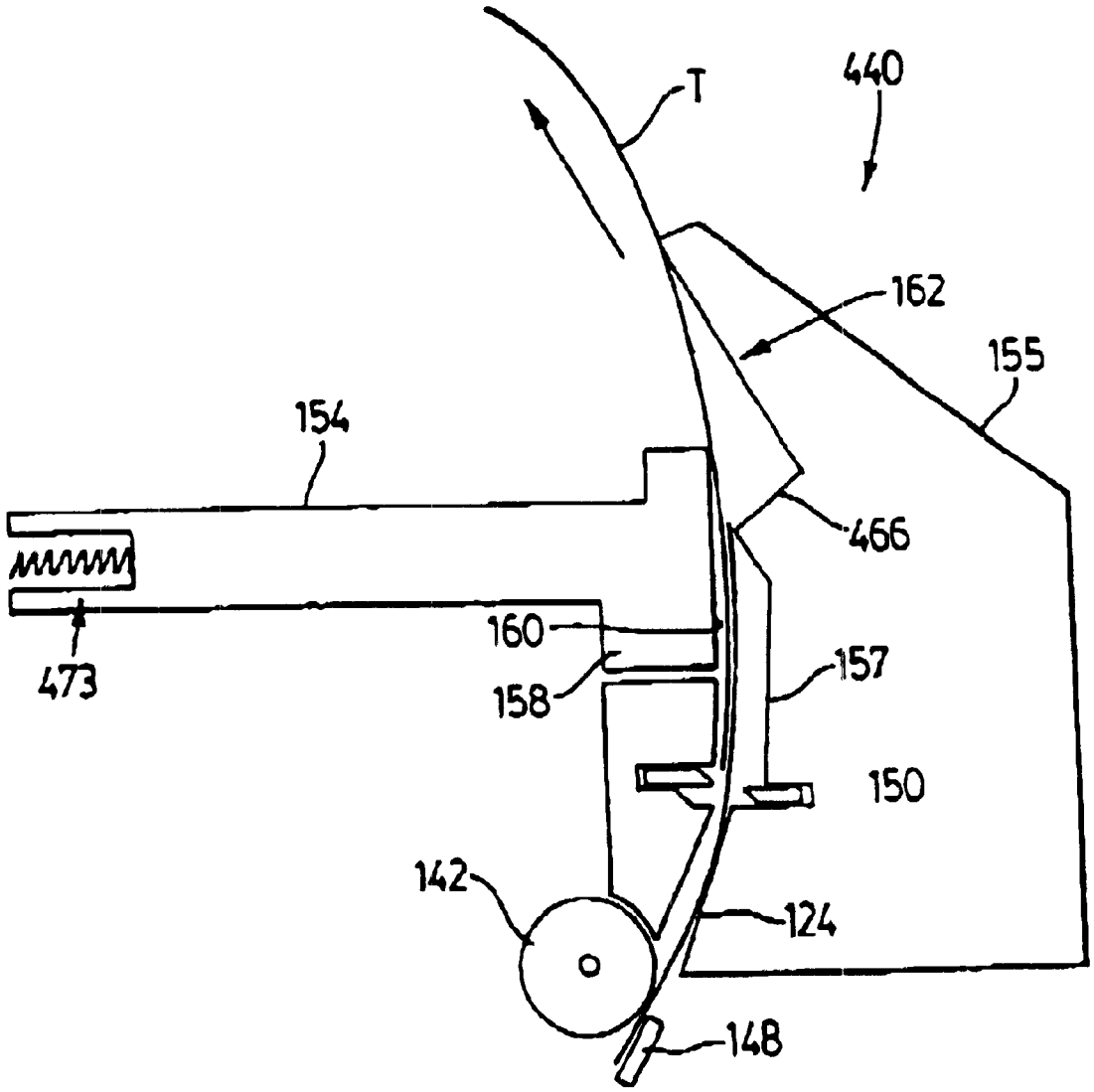
FIG. 7 is a schematic drawing of still yet another alternative embodiment of a ticket dispensing mechanism in accordance with the present invention.

Turning now to FIG. 7, another embodiment of a ticket dispensing mechanism 440 is shown and includes a retaining mechanism 464 very similar to the previous embodiment. However, in this embodiment the deflector 466 is stationary and is integrally formed with the guide wall 157 of the paper guide 155. The ticket tray 154 however includes a pair of tray elements (only one of which is shown) moveable relative to one another. A spring 473 acts between the tray elements to bias the upright wall 160 towards the deflector 466.

Figure 8:
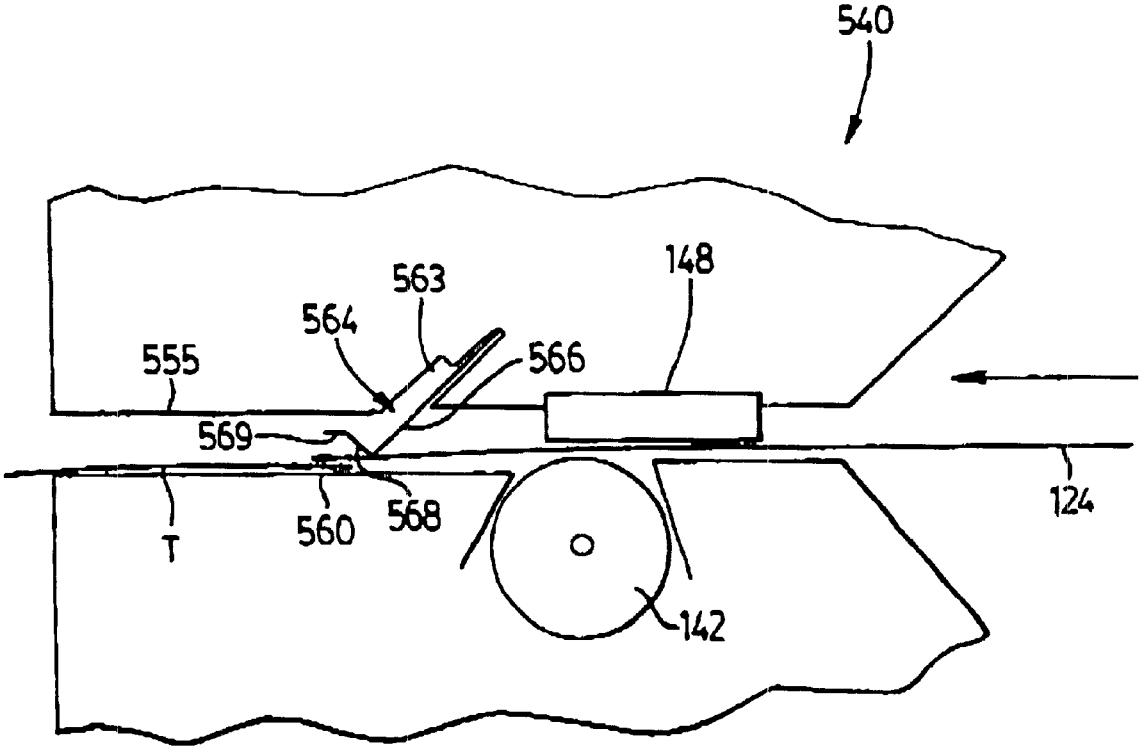
FIG. 8 is a schematic drawing of still yet another alternative embodiment of a ticket dispensing mechanism in accordance with the present invention.

Turning now to FIG. 8 yet another embodiment of a ticket dispensing mechanism is shown. In this embodiment, the ticket dispensing mechanism 540 receives pre-cut forms 124 on which ticket information is to be printed. The print head 148 and retaining mechanism 564 are in a generally horizontal disposition and thus, the pre-cut forms travel along a horizontal path through the ticket dispensing mechanism 540. The platen 154 is positioned below the print head 148 to advance the pre-cut forms as tickets are to be printed.

The retaining mechanism 564 in this embodiment is in the form of a resilient flexible retainer strip. The retainer strip 564 is partially accommodated in an angled 563 recess formed in an upper support 565 and extends into the ticket path towards a lower support 560. The flexible retainer strip 564 includes a first flank 566 extending into the recess 563.

A second flank 568 is integral with the first flank through a right-angle bend and is positioned between the upper and lower supports 555 and 560 respectively. The second flank 568 terminates in a small ledge 569 to give the retainer strip 564 a generally Z-shaped profile.

In operation, as each pre-cut form 124 is printed to form a ticket T and advanced by the platen 142, the leading edge of the ticket is deflected by the flank 566 towards the lower support 560 so that it passes between the retainer strip 564 and the upper surface of the support 560. The resilient biased nature of the retainer strip 564 presses the ticket T against the upper surface of the support 560. As the next pre-cut form is printed to form a ticket and advanced by platen 142, the ticket frictionally overlaps with the previously formed ticket held between the retainer strip 564 and the support surface 560 and ejects the ticket.

Although the above-described embodiments show the paper web or pre-cut form being guided by the retaining mechanisms such that the paper web or pre-cut form frictionally overlaps with the held ticket and entrains the held ticket to eject it as the paper web or pre-cut form is advanced, the retaining mechanisms can be positioned so that the leading end of the paper web or pre-cut form abuts the held ticket to eject it as the paper web or pre-cut form is advanced.

Figure 9:
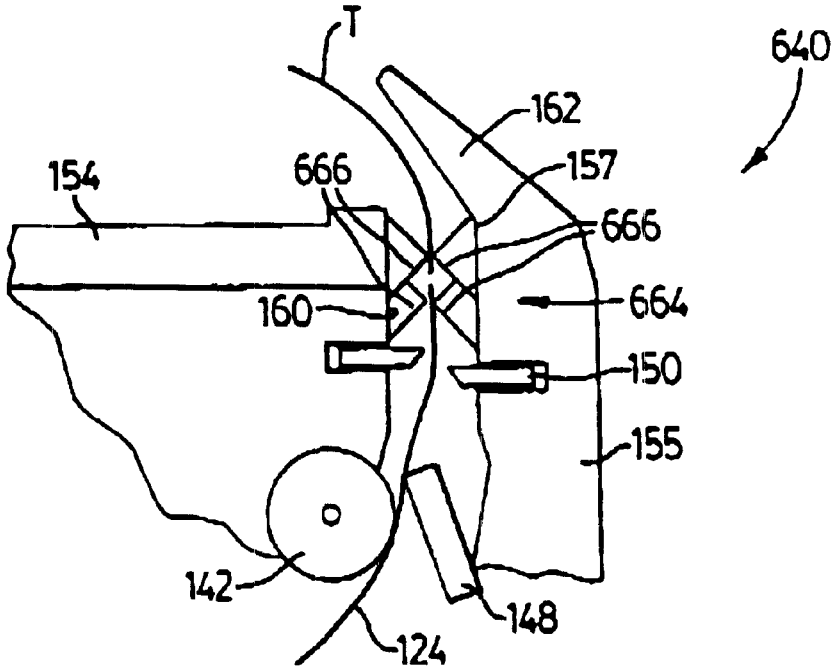
FIG. 9 is a schematic drawing of still yet another alternative embodiment of a ticket dispensing mechanism in accordance with the present invention.

For example, FIG. 9 shows yet another embodiment of a ticket dispensing mechanism 640 in accordance with the present invention. In this embodiment, the retaining mechanism 664 includes upper and lower pairs of resilient flexible retainer strips 666. One retainer strip 666 of each pair is mounted on the guide wall 157 while the other retainer strip of each pair is mounted on the upright wall 160. The upper pair of retainer strips holds a printed ticket while the lower pair of retainer strips aligns the advancing paper web with the printed ticket held by the upper retainer strips so that the advancing paper web abuts the bottom edge of the held ticket T and ejects it from the ticket dispensing mechanism.

In arrangements where the paper web or pre-cut form abuts the bottom edge of the held ticket T to eject it, the paper web can be cupped in one direction and the held ticket cupped in the opposite direction to enhance abutment of the paper web and held ticket. This can be achieved by shaping the platen and the print head so that the paper web leaves the platen cupped in one direction and by shaping the retaining mechanism or upright wall 160 so that the held ticket is cupped in the opposite direction. Alternatively, the guide surface 157 between the print head 148 and the cutting device 150 can be shaped to cup the paper web in the one direction.

Figure 10:
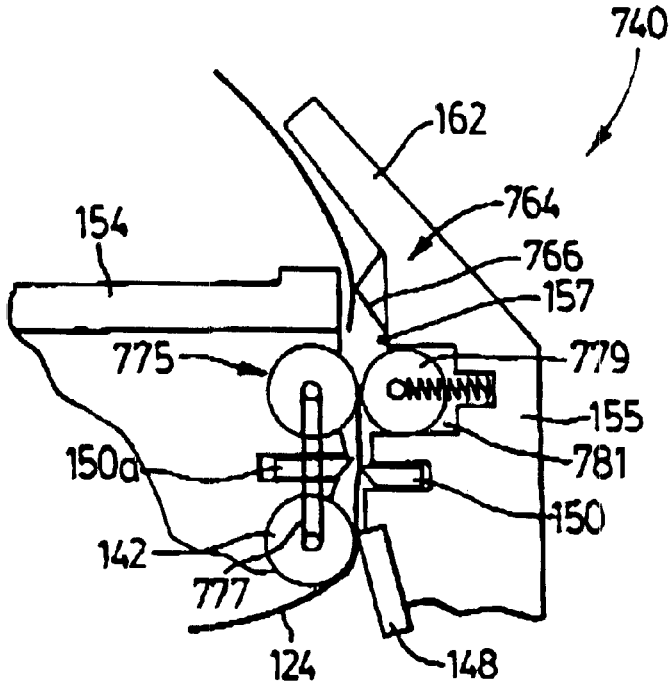
FIG. 10 is a schematic drawing of still yet another alternative embodiment of a ticket dispensing mechanism in accordance with the present invention.

FIG. 10 shows still yet another embodiment of a ticket dispensing mechanism 740 in accordance with the present invention. In this embodiment, the retaining mechanism 764 is similar to that of the first embodiment and includes a flexible retainer strip 766 mounted on the guide wall 157 of the paper guide 155. The retainer strip 766 is however positioned adjacent the end of the ticket tray 154. In this embodiment, the flange is removed from the ticket tray 154. A driven roller 775 is positioned above the cutting blade 150*a* and below the end of the ticket tray 154. The driven roller 775 is coupled to the platen by a belt 777. A spring roller 779 is accommodated by a recess 781 formed in the guide wall 157 and is positioned to form a nip with the driven roller 775. The driven roller 775 and spring roller 779 help to push the advancing paper web toward the retaining mechanism.

While a number of embodiments of the present invention have been illustrated in the accompanying drawings and described hereinabove, it will be evident to those skilled in the art that changes and modifications may be made without departing from the spirit and scope thereof as defined by the appended claims.

What is claimed is:

1. A ticket dispensing mechanism comprising:

a drive receiving sheet material from a supply and advancing said sheet material;

a printer printing ticket information on the sheet material thereby to form a succession of printed tickets, each printed ticket having a leading end;

a retaining mechanism receiving each printed ticket advanced by said drive in succession and pressing each printed ticket against a generally planar surface thereby to hold said each printed ticket; and a guide guiding each printed ticket as it is advanced by said drive such that the leading end of each successive printed ticket contacts and ejects the printed ticket held by said retaining mechanism prior to itself being held by said retaining mechanism, wherein said retaining mechanism includes a member extending towards said generally planar surface, at least one of said member and generally planar surface being urged towards the other by a spring element, each printed ticket passing between said member and said generally planar surface and being pressed against said generally planar surface by said member.

2. A ticket dispensing mechanism as defined in claim 1 wherein said member includes a rotatable wheel biased towards said generally planar surface by said spring element.

3. A ticket dispensing mechanism as defined in claim 2 wherein said wheel deflects the leading end of each printed ticket towards said generally planar surface as each printed ticket is advanced by said drive so that the printed ticket being advanced by said drive frictionally overlaps with the printed ticket held by said retaining mechanism thereby to constitute said guide.

4. A ticket dispensing mechanism as defined in claim 1 wherein said member includes an inclined plate, said plate being hinged at one end and being biased by said spring element in a direction to urge a distal end thereof towards said generally planar surface.

5. A ticket dispensing mechanism as defined in claim 4 wherein said plate deflects the leading end of each printed ticket towards said generally planar surface as each printed ticket is advanced by said drive so that the printed ticket being advanced by said drive frictionally overlaps with the printed ticket held by said retaining mechanism thereby to constitute said guide.

6. A ticket dispensing mechanism as defined in claim 1 wherein said member includes a rigid deflector having a pointed distal end directed towards said generally planar surface, said deflector deflecting the leading end of each printed ticket towards said generally planar surface as each printed ticket is advanced by said drive so that the printed ticket being advanced by said drive frictionally overlaps with the printed ticket held by said retaining mechanism thereby to constitute said guide.

7. A ticket dispensing mechanism as defined in claim 6 wherein said deflector is biased towards said generally planar surface by said spring element.

8. A ticket dispensing mechanism as defined in claim 6 wherein said generally planar surface is biased towards said deflector by said spring element.

9. A ticket dispensing mechanism as defined in claim 1 wherein said supply of sheet material is in the form of a web, said ticket dispensing mechanism further including a cutting device cutting said web after said web has been printed and advanced to said retaining mechanism thereby to form each said printed ticket.

10. A ticket dispensing mechanism as defined in claim 1 further including a deflector to deflect ejected tickets onto a ticket receiving surface.

11. A ticket dispensing mechanism as defined in claim 10 wherein said ticket dispensing mechanism is disposed in a housing having a body and a lid, an upper surface of said lid constituting said ticket receiving surface.

12. A ticket dispensing mechanism as defined in claim 11 wherein said lid carries a flange, said flange being positioned adjacent said retaining mechanism and defining said generally planar surface.

13. A ticket dispenser comprising:

a housing defining an internal chamber for receiving a roll of paper web;

a drive receiving said paper web and advancing said paper web when a ticket is to be formed;

a printer printing ticket information on said paper web as said paper web is advanced by said drive;

a retaining mechanism receiving the printed paper web advanced by said drive; and a cutting device cutting said paper web after said paper web has been printed and advanced to said retaining mechanism thereby to separate tickets from said paper web in succession, wherein said retaining mechanism presses and holds each ticket in succession against a generally planar surface and guides said paper web in a manner such that when the paper web is advanced by said drive during formation of a successive ticket, a leading end of the paper web contacts and ejects the ticket held by said retaining mechanism from said housing, said retaining mechanism including a member extending towards said generally planar surface, at least one of said member and generally planar surface being urged towards the other by a spring element, each held ticket being pinned between said member and generally planar surface.

14. A ticket dispenser as defined in claim 13 wherein said paper web frictionally overlaps with the ticket held by said retaining mechanism to eject the ticket held by said retaining mechanism as said paper web is advanced.

15. A ticket dispenser as defined in claim 14 wherein said member includes a rotatable wheel biased towards said generally planar surface by said spring element.

16. A ticket dispenser as defined in claim 15 wherein said wheel deflects the leading end of said paper web towards said generally planar surface as said paper web is advanced by said drive so that the paper web frictionally overlaps with the ticket held by said retaining mechanism.

17. A ticket dispenser as defined in claim 14 wherein said housing includes a lid defining an upper ticket receiving surface and a deflector to deflect each ticket ejected from said retaining mechanism onto said ticket receiving surface.

18. A ticket dispenser as defined in claim 14 wherein said member includes an inclined plate, said plate being hinged at one end and being biased by said spring element in a direction to urge a distal end thereof towards said generally planar surface.

19. A ticket dispenser as defined in claim 18 wherein said plate deflects the leading end of said paper web towards said generally planar surface as said paper web is advanced by said drive so that the paper web frictionally overlaps with the ticket held by said retaining mechanism.

20. A ticket dispenser as defined in claim 14 wherein said member includes a rigid deflector having a pointed distal end directed towards said generally planar surface, said deflector deflecting the leading end of said paper web towards said generally planar surface as said paper web is advanced by said drive so that the paper web frictionally overlaps with the ticket held by said retaining mechanism.

21. A ticket dispenser as defined in claim 20 wherein said deflector is biased towards said generally planar surface by said spring element.

22. A ticket dispenser as defined in claim 20 wherein said generally planar surface is biased towards said deflector by said spring element.

23. A ticket dispenser as defined in claim 13 wherein said paper web abuts the end of the ticket held by said retaining mechanism to eject the held ticket as said paper web is advanced.

24. A ticket dispensing mechanism comprising:

a drive receiving sheet material from a supply and advancing said sheet material;

a printer printing ticket information on the sheet material thereby to form a succession of printed tickets, each printed ticket having a leading end;

a retraining mechanism receiving each printed ticket advanced by said drive in succession;

a guide guiding each printed ticket as it is advanced by said drive to said retaining mechanism such that the leading end of the printed ticket being advanced abuts an end of the printed ticket held by said retaining mechanism thereby to eject the held printed ticket, wherein said retaining mechanism and guide each include a pair of opposed resilient strips, the resilient strips of said retaining mechanism holding each printed ticket therebetween, and the resilient strips of said guide aligning each printed ticket being advanced by said drive with the printed ticket held by said retaining mechanism.

25. A ticket dispensing mechanism as defined in claim 24 further including means to cup the printed ticket held by said retaining mechanism in one direction and cup the leading end of each printed ticket being advanced by said drive in an opposite direction.

26. A ticket dispensing mechanism as defined in claim 24 wherein said supply of sheet material is in the form of a web, said ticket dispensing mechanism further including a cutting device cutting said web after said web has been printed and advanced to said retaining mechanism thereby to form said printed ticket.

27. A ticket dispensing mechanism as defined in claim 26 further including a deflector to deflect each ejected printed ticket onto a ticket receiving surface.

28. A ticket dispensing mechanism as defined in claim 27 wherein said ticket dispensing mechanism is disposed in a housing having a body and a lid, an upper surface of said lid constituting said ticket receiving surface.

29. A ticket dispenser comprising:

a housing defining an internal chamber receiving a roll of paper and having an upper ticket receiving surface;

a paper web guide directing a paper web unwound from said roll in said chamber along a generally vertical path towards said ticket receiving surface, said paper web guide including a substantially upright wall portion with an upper edge and a retainer mechanism acting on said paper web so as to retain against the upright wall portion, the paper web advancing along said path, said retainer mechanism including at least one element adjacent said upright wall portion and a spring biasing at least one of said at least one element and upright wall portion towards one another to trap said paper web between said at least one element and said upright wall portion;

a drive unwinding said paper web from said roll and advancing said paper web along said path;

a cutting mechanism cutting the paper web into discrete tickets; and a deflector deflecting each ejecting ticket towards said ticket receiving surface.

30. A ticket dispenser as defined in claim 29 wherein said deflector has an operative deflector extending above said ticket receiving surface and oriented so as to deflect each ejected ticket onto said ticket receiving surface.

31. A ticket dispenser as defined in claim 30 further including a printhead printing information on said paper web.

32. A ticket dispenser as defined in claim 31 wherein said drive includes a drum and a motor to rotate said drum, said drum being positioned adjacent an upright support surface laterally offset from said upright wall portion and forming part of said path, said paper web passing between said drum and said upright support surface and being advanced along said path when said drum is rotated.

33. A ticket dispenser as defined in claim 32 wherein said printhead is positioned adjacent said drum.

34. A ticket dispenser as defined in claim 32 wherein said housing includes a body and a lid for said body, said lid being movable between a closed and an open positioned with respect to said chamber and defining said ticket receiving surface.

35. A ticket dispenser as defined in claim 34 wherein said drum is carried by said lid and is positioned adjacent said upright support surface when said lid is in said closed position.

36. A ticket dispenser as defined in claim 32 wherein said member includes a rotatable wheel partially accommodated by said upright support surface, said wheel being biased towards said upright wall portion by said spring.

37. A ticket dispenser as defined in claim 36 wherein said wheel deflects the leading end of said paper web towards said upright wall portion as said paper web is advanced by said drive so that the paper web frictionally overlaps with the ticket held by said retainer mechanism.

38. A ticket dispenser as defined in claim 32 wherein said member includes an inclined plate partially accommodated by said upright support surface, said plate being hinged at one end and being biased by said spring in a direction to urge a distal end thereof towards said upright wall portion.

39. A ticket dispenser as defined in claim 38 wherein said plate deflects the leading end of said paper web towards said upright wall portion as said paper web is advanced by said drive so that the paper web frictionally overlaps with the ticket held by said retainer mechanism.

40. A ticket dispenser as defined in claim 32 wherein said member includes a rigid deflector partially accommodated by said upright support surface and having a pointed distal end directed towards said upright wall portion, said deflector deflecting the leading end of said paper web towards said upright wall portion as said paper web is advanced by said drive so that the paper web frictionally overlaps with the ticket held by said retainer mechanism.

41. A ticket dispenser as defined in claim 40 wherein said deflector is biased towards said upright wall portion by said spring.

42. A ticket dispenser as defined in claim 40 wherein said upright wall portion is biased towards said deflector by said spring.

43. A ticket dispenser comprising:

a housing including a body defining an internal chamber for receiving a roll of paper and a lid for said body, said lid being moveable between a closed position and an open position to expose said internal chamber and having an upper ticket receiving surface;

a paper web guide to direct a paper web unwound from said roll in said internal chamber along a generally vertical path towards said ticket receiving surface, said paper web including a substantially upright wall portion with an upper edge and a retainer mechanism acting on said paper web so as to retain against the upright wall portion, the paper web advanced along said path, said retainer mechanism including at least one element adjacent said upright wall portion and a spring biasing at least one of said at least one element and upright wall portion toward one another to trap said paper web between said at least one element and said upright wall portion;

a drive actuable to unwind said paper web from said roll and advance said paper web along said path;

a cutting mechanism for cutting the paper web into discrete tickets; and a deflector orientated so as to deflect each ejected ticket towards the ticket receiving surface.

44. A ticket dispenser as defined in claim 43 wherein said deflector has an operative deflector surface extending above said ticket receiving surface and oriented so as to deflect each ejected ticket onto the ticket receiving surface.

45. A ticket dispenser as defined in claim 44 further including a printhead to print information on said paper web.

46. A ticket dispenser as defined in claim 45 wherein said drive includes a drum and a motor to rotate said drum, said drum being positioned adjacent an upright support surface laterally offset from said upright wall portion and forming part of said path, said paper web passing between said drum and said upright support surface and being advanced along said path when said drum is rotated.

47. A ticket dispenser as defined in claim 46 wherein said printhead is positioned adjacent said drum.

48. A ticket dispenser as defined in claim 47 wherein said drum is carried by said lid and is positioned adjacent said upright support surface when said lid is in said closed position.

49. A ticket dispenser as defined in claim 46 wherein said member includes a rotatable wheel partially accommodated by said upright support surface, said wheel being biased towards said upright wall portion by said spring.

50. A ticket dispenser as defined in claim 49 wherein said wheel deflects the leading end of said paper web towards said upright wall portion as said paper web is advanced by said drive so that the paper web frictionally overlaps with the ticket held by said retainer mechanism.

51. A ticket dispenser as defined in claim 46 wherein said member includes an inclined plate partially accommodated by said upright support surface, said plate being hinged at one end and being biased by said spring in a direction to urge a distal end thereof towards said upright wall portion.

52. A ticket dispenser as defined in claim 51 wherein said plate deflects the leading end of said paper web towards said upright wall portion as said paper web is advanced by said drive so that the paper web frictionally overlaps with the ticket held by said retainer mechanism.

53. A ticket dispenser as defined in claim 46 wherein said member includes a rigid deflector partially accommodated by said upright support surface and having a pointed distal end directed towards said upright wall portion, said deflector deflecting the leading end of said paper web towards said upright wall portion as said paper web is advanced by said drive so that the paper web frictionally overlaps with the ticket held by said retainer mechanism.

54. A ticket dispenser as defined in claim 53 wherein said deflector is biased towards said upright wall portion by said spring.

55. A ticket dispenser as defined in claim 53 wherein said upright wall portion is biased towards said deflector by said spring.

* * * * *